US005393294A

United States Patent [19]

Jobst

[11] Patent Number: 5,393,294

[45] Date of Patent: Feb. 28, 1995

[54] METHOD AND APPARATUS FOR PRODUCING SHEETS OF CORRUGATED CARDBOARD WITH A VARIABLE FORMAT

[75] Inventor: Lothar Jobst, Weiherhammer/Opf., Germany

[73] Assignee: BHS Corrugated Maschinen- und Anlagenbau GmbH, Germany

[21] Appl. No.: 950,079

[22] Filed: Sep. 23, 1992

[30] Foreign Application Priority Data

Oct. 11, 1991 [DE] Germany ..... 4133760

[51] Int. Cl.[6] ..... B31B 1/14

[52] U.S. Cl. ..... 493/342; 493/227; 493/237; 493/239; 493/362; 493/364; 493/373; 493/369; 83/663; 83/407; 83/865; 83/864; 83/44; 83/47; 83/51

[58] Field of Search ..... 493/227, 230, 237, 238, 493/239, 189, 342, 361, 362, 363, 364, 365, 366, 369, 370, 373, 378, 359, 287, 288, 229; 83/864, 865, 877, 879, 44, 45, 47, 51, 407, 408, 663, 869, 885

[56] References Cited

U.S. PATENT DOCUMENTS

| | | | |
|---|---|---|---|
| 2,655,844 | 3/1949 | Sillars . | |
| 3,888,201 | 10/1974 | Eggert et al. | 93/36 A |
| 4,171,081 | 10/1979 | Vossen et al. | 493/373 |
| 4,563,930 | 1/1986 | Schommler et al. | 493/361 |
| 4,809,573 | 3/1989 | Welch | 83/37 |
| 5,152,205 | 10/1992 | Yoshida et al. | 83/304 |
| 5,197,938 | 3/1993 | Chmielewski | 493/373 |

FOREIGN PATENT DOCUMENTS 260008 10/1926 Germany .

*Primary Examiner*—Bruce M. Kisliuk
*Assistant Examiner*—Eileen P. Morgan
*Attorney, Agent, or Firm*—Silverman, Cass & Singer, Ltd.

[57] ABSTRACT

Method for producing sheets of corrugated cardboard with a variable format in which a web of corrugated cardboard is removed continuously from a heating and pulling device of s conventional corrugated cardboard installation. The sheets are processed to the required format in at least one longitudinal cutting and grooving device. For this purpose the web is conveyed through a pulling device. A cross cutter cuts the sheets of corrugated cardboard from the cardboard web according to a preset format. The cardboard web is conveyed to a cross cutter for the corrugated cardboard sheets in the direction of conveyance without cutting them crosswise. When the format is changed, the area of the web of corrugated cardboard where the formats overlap is cut out by the cross cutter and removed to a waste container through a trap.

9 Claims, 2 Drawing Sheets

METHOD AND APPARATUS FOR PRODUCING SHEETS OF CORRUGATED CARDBOARD WITH A VARIABLE FORMAT

BACKGROUND OF THE INVENTION

1. Field of the Invention

This invention relates generally to a method and apparatus for producing sheets of corrugated cardboard with a variable format.

2. Description of the Related Art

It is known to provide a corrugated cardboard installation in which the web of corrugated cardboard is removed from a heating and pulling device at a predetermined operating speed and is divided across the entire width of the web by a cross cutter when the format of the corrugated cardboard sheets that are to be produced is changed. The remaining web for a certain number of sheets in a lot is then accelerated and the new web of cardboard arriving from the heating and pulling device is slowed down, thus resulting in a gap between the remaining web leaving the machine and the new web coming in. During this gap in the cardboard web, the longitudinal cutting and grooving device and cross cutter are reset for the new format. A disadvantage of this arrangement is that the remaining web leaving the machine and the new web arriving in the direction of conveyance are not subjected to tension and therefore are not guided adequately. This results in cutting differences on the cross cutter and cutting and grooving differences on the longitudinal cutting and grooving device. This results in unnecessarily large volumes of waste and in some cases, break-downs in operations. This is especially problematical with corrugated cardboard webs that are preprinted and must be cut with high precision. Furthermore, the working speed must be varied in order to form the gap.

SUMMARY OF THE INVENTION

The present invention provides a method for producing corrugated cardboard webs with a variable format and apparatus for carrying out the method in which only minimal waste occurs even in the high speed range when changing formats. The area of the web of corrugated cardboard leaving the machine must not contain any incorrect sheets in the lot if at all possible. Furthermore., there should not be any major negative effects on the overall speed of the corrugated cardboard installation. In addition, changes in speed should for the most part be prevented.

Due to the fact that the corrugated cardboard web is conveyed to the cross cutter for the corrugated web sheets in the direction of conveyance without being cut crosswise, guidance and accurate conveyance movement can be maintained. The cuts running across and longitudinally are executed accurately and in the proper positions. When the area of the web of corrugated cardboard where the formats overlap is cut out in the form of sheets by the cross cutter when changing formats, even this results in only relatively minimal waste. Furthermore, it is also possible to work at a maximum velocity continuously. Increases and decreases in speed are largley prevented.

The invention is explained with reference to an embodiment illustrated in the figures, which show the following:

BRIEF DESCRIPTION OF THE DRAWINGS

FIG. 8 is a partial top view of a web of corrugated cardboard.

DESCRIPTION OF THE PREFERRED EMBODIMENT

Figure 1:
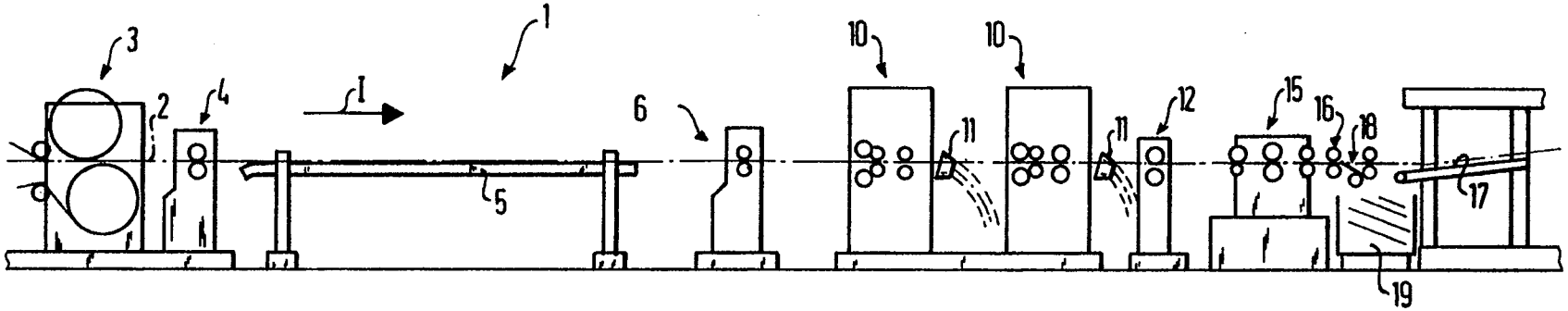
FIG. 1 is a schematic side view of a portion of a corrugated cardboard installation in accordance with the invention.
Figure 2:
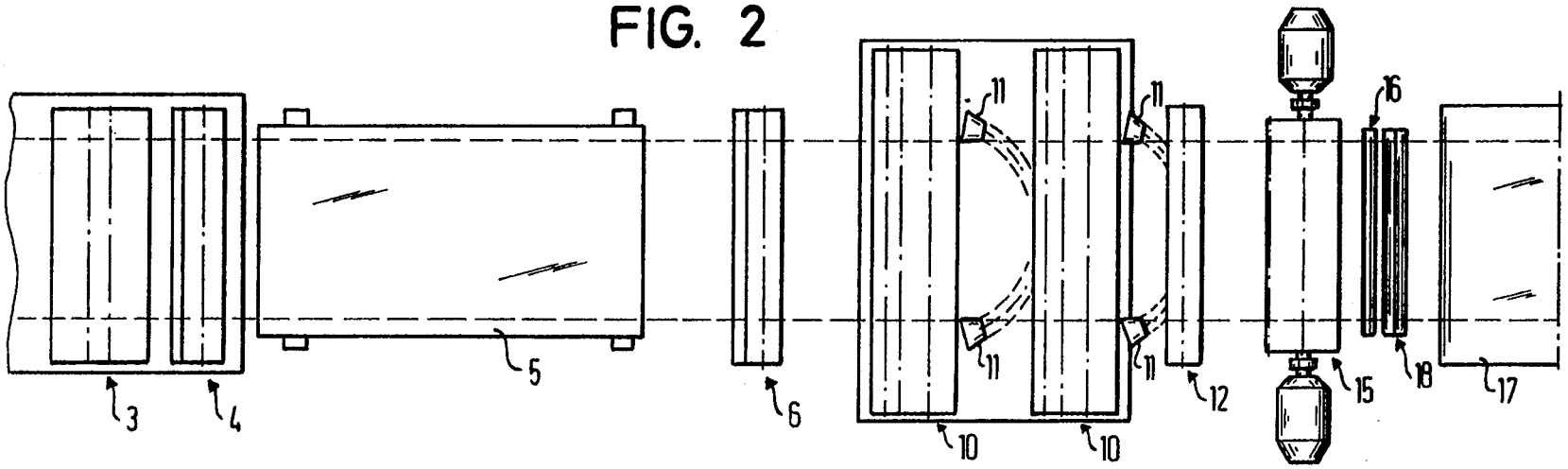
FIG. 2 is a top view thereof.

In the corrugated cardboard installation 1 according to FIG. 1, the web 2 of corrugated cardboard is conveyed in the direction of arrow I from the heating and pulling device 3. Web 2 may be formed a double-sided or double-double corrugated cardboard.

Corrugated cardboard web 2 then moves to a cross cutter 4 which serves only to remove waste from web 2 at the start of production or during production. Then, corrugated cardboard web 2 moves to a transfer table 5.

Next, a cross cutting device 6 cuts the corrugated cardboard web 2 at the side in the edge area for a predetermined length. Preferably, this cut length is selected in accordance with the difference between the maximum and minimum web width to be processed on the installation.

The corrugated cardboard web 2 which has been cut crosswise but not completely then moves further to at least one longitudinal cutting and grooving device 10 or, as shown in the preferred embodiment, two successive longitudinal cutting and grooving devices 10. Said devices 10 operate alternately. The cutting and grooving tools of one device 10 are not in operation or set during the formatting of a first batch of sheets. When "changing formats," i.e., after reaching a predetermined number of corrugated cardboard sheets with a certain format, the tools of the longitudinal cutting and grooving device 10 which have previously been in operation are retracted and the tools of the other longitudinal cutting and grooving device 10 that have not previously been in operation are engaged.

The longitudinal cutting and grooving device 10 that is in operation also cuts the corrugated cardboard web 2 passing through it at the sides, thus forming edge strips between which the longitudinal cutting and grooving tools are arranged according to a preselected format.

Each longitudinal cutting and grooving device 10 has its own conveying device 11 to convey the edge strips to waste containers (not shown). Preferably, suction devices are used for the conveying devices 11. In order for the edge strips to be conveyed away safely, the conveyance devices 11 are adjustable in the transverse direction depending on the format, and therefore the width, of the longitudinal strip.

The cross cutting device 6 is switched on when changing formats. The necessary partial cut of the longitudinal edges of the web running inwardly across the web is executed over a suitable length when the web length that corresponds to a predetermined number of batches has passed through the cross cutting device 6. The edge strips that have thus been removed are conveyed away by conveying device 11.

Positioned after the last longitudinal cutting and grooving device 10 in the direction of conveyance, there is a pulling device 12 which exerts a constant tensile force on the corrugated cardboard web 2 passing therethrough. The portion of the web from the heating and drying device 3 up to said pulling device 12 thus remains guided because it has not been cut completely across. The required cuts or corrugations can thus be executed accurately.

After pulling device 12, corrugated cardboard web 2 then passes through a transfer station and enters a simplex cross cutter 15 which is designed in a simple arrangement which separates corrugated cardboard web 2 across its entire width into the corrugated cardboard sheets predetermined by the given format.

A delivery device 16 grips the cut sheets and conveys them to a conventional sheet stacker 17. In this way, the different lots of sheets can be stacked in different sheet holders.

A sheet trap 18 that diverts waste sheets from the area of the corrugated cardboard where the preceding format and the next format overlap to a waste container 19 is integrated into delivery device 16. In this way, the preceding batch as well as the following batch are free of sheets with miscuts or grooves.

The defective sheets are cut out by means of a simplex cross cutter 15 which is controlled preferably in accordance with the peripheral speed such that the defective cuts in the area of the overlapping of the two formats (previous format and new format) are made in synchronization with the working speed of the entire corrugated cardboard installation 1 in which there is no change.

As a result of the special arrangement of different devices along the direction of conveyance of corrugated cardboard web 2 which is to be processed, the corrugated cardboard web 2 is under a constant tensile force exerted by pulling device 12 while the web is still uncut. Therefore, the entire segment of corrugated cardboard remains at a constant tensile force at all times on the heating and pulling device 3 and is guided at the sides. Defective cuts and thus wast are minimized.

Figure 3:
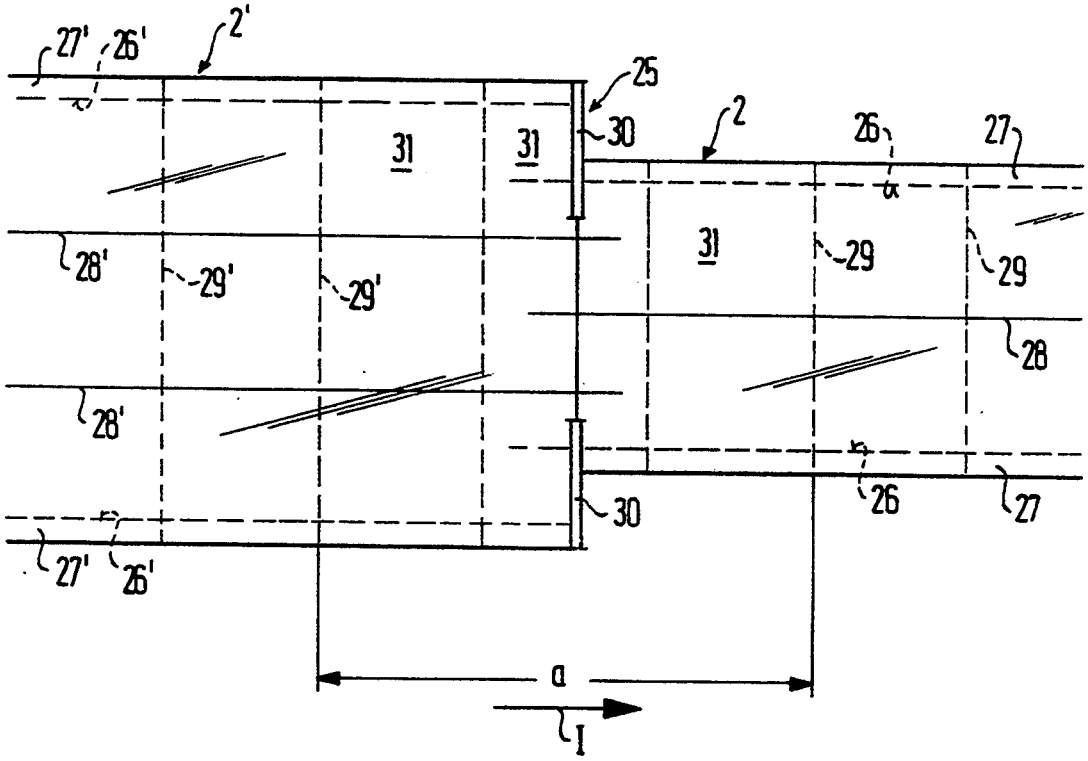

As seen in FIG. 3, the narrower corrugated cardboard web 2 passing through installation 1 is spliced with a wider web 2' of corrugated cardboard in the splice area 25.

The tools of the longitudinal cutting and grooving device 12 which are set for web 2 execute longitudinal cuts 26 at the sides for longitudinal edges 27 and longitudinal format cuts 28. These cuts 26 also extend into web 2' in splice area 25.

Crosscuts 29 extending over the entire width of the web are executed by simplex cross cutter 15. In the transitional area between the previous format 29 and the next format 29', the crosscuts are not executed in the proper manner required by the format. In order for longitudinal strips 27 to be conveyed away, cuts 30 are executed at the transitional point from web 3 to web 3' in splice area 25 (across web 2, by cross cutter 6).

Cuts 31 in the web part over length a which are not executed in accordance with the required format are cut out by simplex cross cutter 15 and removed as waste.

The other cuts 26' that are in the proper format for longitudinal edges 27' and longitudinal format cuts 28' for web 2' are executed by the longitudinal cutting and grooving device 10 which is in the working position.

Simplex cross cutter 15 executes the crosscuts 29' for web 2' in the proper format with a new setting.

It is self-evident that even splice webs 2, 2' of the same width but with new sheet formats can also be processed in the same way in installation 1.

I claim:

1. Method for producing corrugated cardboard sheets having variable formats, said method comprising the steps of, continuously conveying a corrugated cardboard web from a heating and pulling device at a uniform speed, processing the web to a predetermined format in at least one longitudinal cutting and grooving device, said web having edge strips cut longitudinally by said longitudinal cutting and grooving device;

cross cutting said web into said sheets by a web cross cutting device so as to conform to said format, said web being conveyed to said web cross cutting device without being severed crosswise, said edge strips being cut crosswise by at least one edge strip cross cutting device and thereafter being conveyed to waste after processing of the web in said longitudinal cutting and grooving device and prior to said web being severed by said web cross cutting device, said web having format areas which overlap and said overlapping areas being cut by said web cross cutting device to produce waste which is removed to a waste container through a sheet trap, and said edge strip cross cutting device having a cutter operating inwardly a predetermined constant distance to cut said edge strips crosswise at each format change along entire length of said web, said predetermined distance being related to the difference between maximum and minimum web widths conveyed.

2. Method as claimed in claim 1 in which there are more than one longitudinal cutting and grooving devices and the web is processed by said cutting and grooving devices alternatively in succession in the direction of conveyance of the web.

3. Method as claimed in claim 1 in which said cross cutting is performed by a simplex cross cutter which also cuts out the areas where the sheets overlap while the web is conveyed at constant speed.

4. Apparatus for producing corrugated cardboard sheets having variable formats cut from a web, said apparatus comprising, a heating and pulling device for continuously conveying the web, at least one longitudinal cutting and grooving device to operate on the web and longitudinally cut edge strips of said web, a web tension device, a first cross cutting device for cutting crosswise said edge strips of the unsevered web, a conveying device and a waste container for conveying the cut edge strips of the unsevered web to the waste container, a second cross cutting device for severing the web completely crosswise to produce said sheets, said second cross cutting device being located downstream from the longitudinal cutting and grooving device in the direction of conveying of the web, and a trap associated with the second cross cutting device to divert overlapping format areas of said web which are removed as waste sheets to an associated waste container, and said first cross cutting device having a cutter operating inwardly a predetermined constant distance to cut said edge strips crosswise at each format change along entire length of said web, said predetermined distance being related to the difference between maximum and minimum web widths conveyed.

5. Apparatus as claimed in claim 4 in which there are more than one longitudinal cutting and grooving devices that operate alternately on the web, said cutting and grooving devices being arranged one after the other in the direction of conveying of the web and being operable to produce variable format sized sheets.

6. Apparatus as claimed in claim 4 including first cross cutting devices for starting cuts on the web that run crosswise in the edge areas of the web, said first cross cutting devices being located upstream from the longitudinal cutting and grooving devices in the direction of conveying of the web.

7. Apparatus as claimed in claim 4 in which the second cross cutting device is a simplex cross cutter.

8. Apparatus as claimed in claim 7 in which said second cross cutting device includes a delivery device, a sheet trap and a waste container.

9. Apparatus as claimed in claim 4 including a stacking device for different lots of sheets.

* * * * *